US006454475B2

(12) United States Patent
Giles et al.

(10) Patent No.: US 6,454,475 B2
(45) Date of Patent: Sep. 24, 2002

(54) METHOD OF CUTTING ROLLFEED MEDIA

(75) Inventors: Robert Giles, Escondido, CA (US); David Hermida, Sant Cugat Del Valles (ES); Tony Lang, Sant Cugat Del Valles (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/930,845

(22) Filed: Aug. 14, 2001

Related U.S. Application Data

(62) Division of application No. 09/183,872, filed on Oct. 30, 1998, now Pat. No. 6,315,474.

(51) Int. Cl.[7] ..... B41J 15/02
(52) U.S. Cl. ..... 400/621; 346/24
(58) Field of Search ..... 400/621, 621.2; 101/93.07, 226; 83/477.2, 487, 508, 483, 484, 485, 563, 578, 582, 583; 346/24

(56) References Cited

U.S. PATENT DOCUMENTS 4,504,162 A * 3/1985 Speraggi ..... 400/621
4,525,088 A * 6/1985 Shipos et al. ..... 400/621
4,701,063 A * 10/1987 Wysk et al. ..... 400/621
5,243,890 A * 9/1993 Ober ..... 83/471.2
5,296,872 A * 3/1994 Caamano ..... 346/24
5,363,123 A * 11/1994 Petersen et al. ..... 346/24
5,436,646 A * 7/1995 Schilling et al. ..... 346/139 R

* cited by examiner

*Primary Examiner*—Ren Yan
(74) *Attorney, Agent, or Firm*—Roth & Goldman

(57) ABSTRACT

A paper cutter assembly for a printer/plotter is mounted on the printhead carriage for movement therewith to avoid separate mounting and guide structure. A cutter wheel is mounted in a housing for cam induced movement between a raised inactive position and a lower active position by engagement of a cam element carrier mounted for movement in the cutter housing with structure on the printer chassis. The printer platen has a stationary cutter bar which extends in a channel in the platen transversely of the path of paper movement and has a cutter wheel receiving well at one end of the channel into which the cutter wheel drops without contacting the platen or cutter bar at commencement of a cutting operation. Camming surfaces on the platen engage the side of a cutter drive wheel to move the cutter wheel into engagement with the cutter bar and then to raise the cutter wheel to the proper amount of operational overlap of the cutting edges as the cutter assembly moves across the paper path. The cutter wheel is moved between its inactive and active positions at one side of the media and damage to the cut edge of rollfeed media is prevented by retracting the rollfeed media edge away from the cutter bar as the cutter wheel returns to said one side of the media after a cut.

5 Claims, 11 Drawing Sheets

METHOD OF CUTTING ROLLFEED MEDIA

CROSS REFERENCE TO RELATED APPLICATION(S)

This is a divisional of application Ser. No. 09/183,872 filed on Oct. 30, 1998 is now U.S. Pat. No. 6,315,474, which is hereby incorporated by reference herein.

CROSS REFERENCE TO RELATED APPLICATIONS IF ANY

None.

BACKGROUND OF THE INVENTION AND PRIOR ART

The present invention relates to computer driven printers and, more particularly, to an improved print media cutter. For ease of reference, instead of the term "print media", the term paper will be frequently used herein and is intended to encompass all forms of print media including paper, transparencies, vellum, etc.

The media cutter assembly of the present invention is primarily designed for large scale printers/plotters which receive print media from a roll supply. After printing of a sheet of media from the roll, a clean transverse cut needs to be made without wrinkling of the media and with a minimum of paper positioning or repositioning to cut the printed sheet and, if necessary, the leading edge of the roll may be further trimmed. A variety of prior art cutting mechanisms have been used including stationary full length linear blades in conjunction with moveable rotary cutting blades mounted on a cutter carriage which in turn moves on cutter carriage support rods or guide tracks separate from the printhead carriage and its support rods or tracks. Both manual and automatic systems have been used including the type disclosed in U.S. Pat. No. 5,296,872 issued Mar. 22, 1994 to Caamano and owned by the assignee of the present invention. In this patent a separate cutter carriage is connected, when desired, to the print head carriage for movement therewith and is disconnected from the print head carriage after the cutting operation.

It is the primary object of the present invention to provide a reliable media cutter assembly which is rigidly connected at all times to the print head carriage so that separate print head and cutter carriages and associated guide structure for each are unnecessary.

SUMMARY OF THE INVENTION

The present invention provides a media cutter assembly for attachment to a moveable printhead carriage of a computer driven printer comprising:

a) a cutter wheel support member having a media cutter wheel mounted thereon for rotation about an axis, said support member also including a first cam element;

b) a cam element carrier and cutter actuator moveable generally transversely to said cutter wheel axis, said carrier having a second cam element thereon engaged by said first cam element and said actuator being engageable with cutter actuation means on said printer;

c) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and d) means for biasing said cutter wheel support member for movement of said cutter wheel toward said active position relative to said housing.

The present invention further provides a printer having a moveable printhead carriage and a print media cutter assembly attached thereto, said media cutter assembly comprising:

a) a cutter wheel support member having a media cutter wheel mounted thereon for rotation about an axis, said support member also including a first cam element;

b) a cam element carrier and cutter actuator moveable generally transversely to said cutter wheel axis, said carrier having a second cam element thereon engaged by said first cam element and said actuator being engageable with cutter actuation means on said printer;

c) a housing having first guide means therein for guiding said cutter wheel support member in a path of movement to move said cutter wheel between inactive and active positions relative to said housing, said housing having second guide means for guiding said cam element carrier relative to said housing in a path of movement generally transverse to said path of movement of said cutter wheel between a cutter inactive position and a cutter active position; and d) means for biasing said cutter wheel support member for movement of said cutter wheel toward said active position relative to said housing;

said printer having an output platen and a stationary elongated cutter bar in a cutter wheel receiving channel which extends transverse to the path of movement of printed media to be cut, said cutter wheel in said cutter active position being engageable with said cutter bar.

The invention further provides a method of cutting printed media sheets in a printer from a rollfeed supply of media comprising the steps of:

a) moving the printed media in a forward direction across a stationary cutter bar which extends transversely to the direction of movement of the media and then holding said media in a stationary position across said cutter bar;

b) using a printhead carriage having an attached cutter assembly to move said cutter assembly in a first direction to a position at a first side of said media to engage means on said cutter assembly with printer structure at said first side of said media;

c) moving said cutter assembly and printhead carriage in a second direction to first move a cutter blade from an inoperative position to an operative position and subsequently engaging said cutter blade with said cutter bar as said cutter assembly moves from said first side of said media to a second side of said media to cut said media; and d) returning said cutter assembly and printhead carriage in said first direction to said first side of said media while said cutter blade remains engaged with said cutter bar and then moving said cutter blade to said inoperative position.

DESCRIPTION OF THE PREFERRED EMBODIMENT

Figure 1:
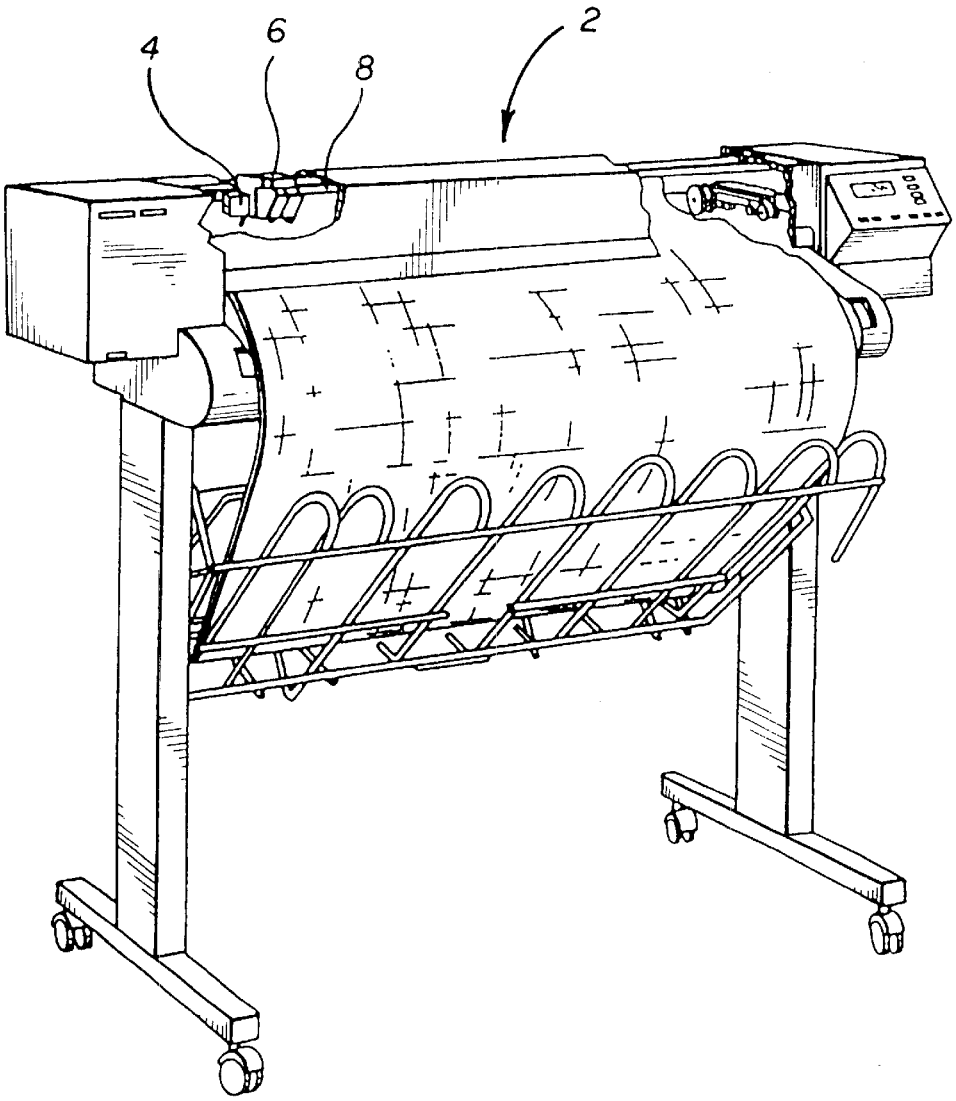
FIG. 1 is a perspective view of a computer driven plotter having a moveable print head carriage and a moveable rotary wheel paper cutter mounted thereon.

The media cutter assembly of the present invention is primarily designed for use in connection with a large scale plotter 2 as shown in FIG. 1; however, the cutter assembly 4 is also adaptable for use with smaller scale printers as well. In FIG. 1 the plotter print head carriage 6 is mounted on slider rods 8. The media cutter assembly 4 of the present invention is attached to and always moves with the print head carriage 6.

Figure 2:
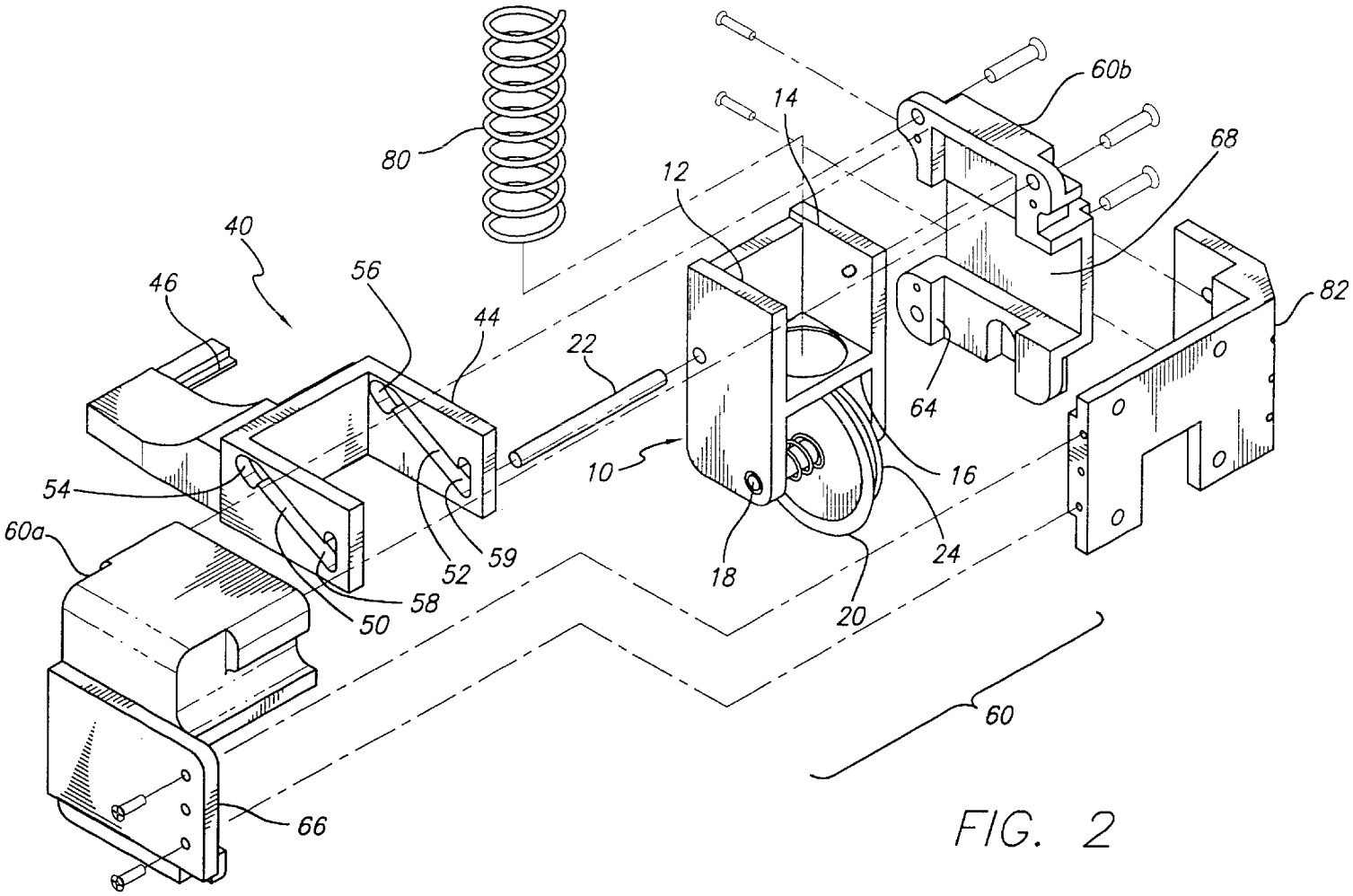
FIG. 2 is an exploded perspective view of the cutter assembly separately showing the rear housing part, the actuation hook and cam element carrier, the vertical bias spring, the cutter holder and the front housing part.

As seen in the exploded view of FIG. 2, the media cutter assembly essentially is comprised of a cutter wheel support member 10, a cam element carrier 40 and a housing 60 having a front part 60*a* and a rear part 60*b* fastened together by screws 60*c* such that the housing 60 contains the cutter wheel support member 10 and the cam element carrier 40, both the cutter wheel support member 10 and the cam element carrier 40 being slideably moveable along mutually perpendicular directions of movement in the housing 60. The cutter wheel support member 10, cam element carrier 40 and housing 60 are all molded plastic parts, the housing having guide rails, channels or tracks for guiding the cutter wheel support member 10 and cam element carrier 40 along their directions of movement.

The cutter wheel support member 10 is comprised of a pair of parallel spaced flanges, 12, 14 interconnected by a transversely extending web 16. The rotatable cutter wheel 20 is mounted on an axle 18 which extends between the flanges 12, 14 on the lower side of the web 16. A rotatable cutter drive wheel 24 is also mounted on the same axle 18 with the cutter wheel 20 and drive wheel 24 is affixed to the cutter wheel 20.

Figure 7:
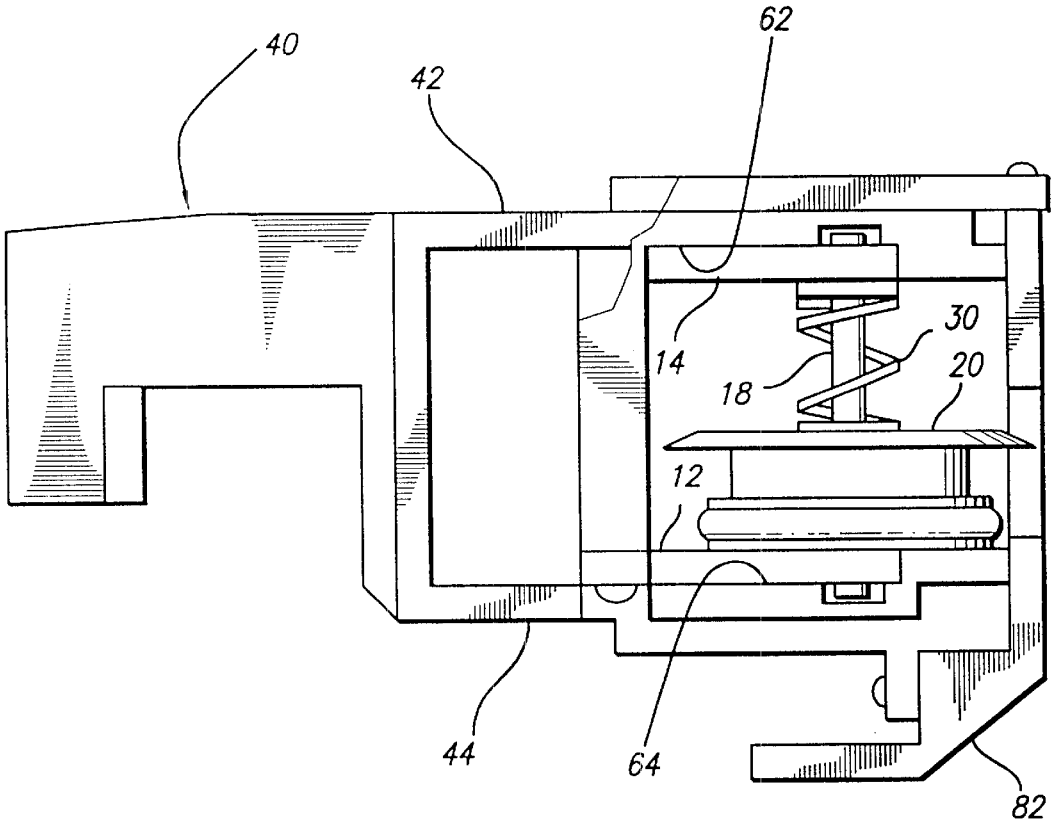
FIG. 7 is a bottom plan view of the cutter.

The parallel cutter wheel support flanges 12, 14 are respectively guided in spaced parallel tracks or guideways 62, 64 in the housing 60 (FIG. 7) for movement of the cutter wheel support member 10 and attached cutter wheel in a generally vertical path as shown. A coil compression spring 80 is seated between the web 16 and an interior upper wall of the housing 60 such the cutter wheel support of a member and cutter wheel is biased downwardly to a lower cutter wheel active position. Preferably, the upper interior wall of the housing 60 and the web 16 may be provided with suitable indentations or projections to provide seats which prevent lateral movement of the ends of the spring 80.

The cam element carrier 40 includes a pair of parallel spaced flanges 42, 44 each having an elongated cam track 50, 52 therein. The housing 60 includes guide tracks 66, 68 which respectively receive the flanges 42, 44 of the cam element carrier to guide the cam element carrier for movement in the guide tracks 66, 68. As shown in the drawings, the guide tracks 62, 64 for the cutter support member 10 and the guide tracks 66, 68 for the cam element carrier 40 are substantially perpendicular to each other although other arrangements are contemplated and within the broader aspects of the invention.

In the preferred embodiment the cutter wheel support member 10 has a transversely extending cam follower rod 22 mounted between the flanges 12, 14, the rod 22 having follower portions near its supported ends which are respectively received in the spaced cam tracks 50, 52. It will be noted that the cam tracks each include a seat 54, 56 at the upper ends thereof as seen in the drawings to receive and seat the follower portions of the rod 22 therein when the cutter wheel 20 is in an upper, inactive position in which the cam tracks 50, 52 and the cutter wheel 20 are substantially enclosed by the walls of the housing 60.

Figure 3:
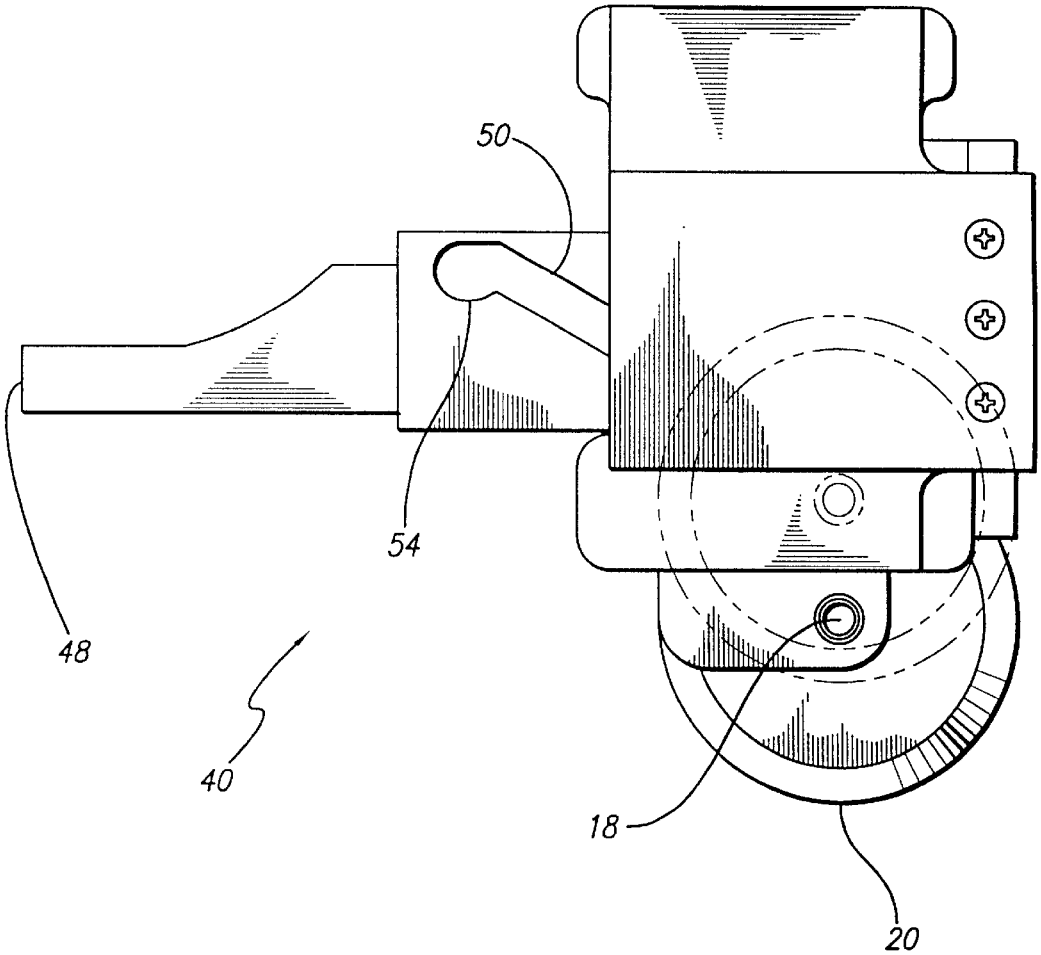
FIG. 3 is a front elevation view showing the cutter wheel in a lowered or active position and showing, in phantom, the cutter wheel in an upper inactive position.

Each cam track 50, 52 has essentially the same configuration including a centrally elongated portion which is angled with respect to the direction of movement of the cutter wheel support member, the tracks 50, 52 extending generally downwardly to the right as seen in FIG. 3 from the seats 54, 56 toward the cutter wheel axle 18. The cam tracks 50, 52 then terminate in a second seat 58, 59 comprising a slightly upwardly extending portion of the cam track which thus extends parallel to the direction of movement of the cutter wheel support. The upwardly extending seats 58, 59 of the cam tracks permit spring biased vertical movement of the cutter wheel 20 relative to the cutter wheel support member 10 when the cutter wheel is in the active position such that the cutter wheel may engage a stationary elongated cutter bar (shown in phantom in FIG. 4) on the output platen of the plotter as is conventional. The vertical extent of the cam tracks and spring biased movement of the cutter wheel permits the cutter wheel to accommodate slight variations in the platen surface from end to end of the path of cutter travel across the media to be cut.

Figure 4:
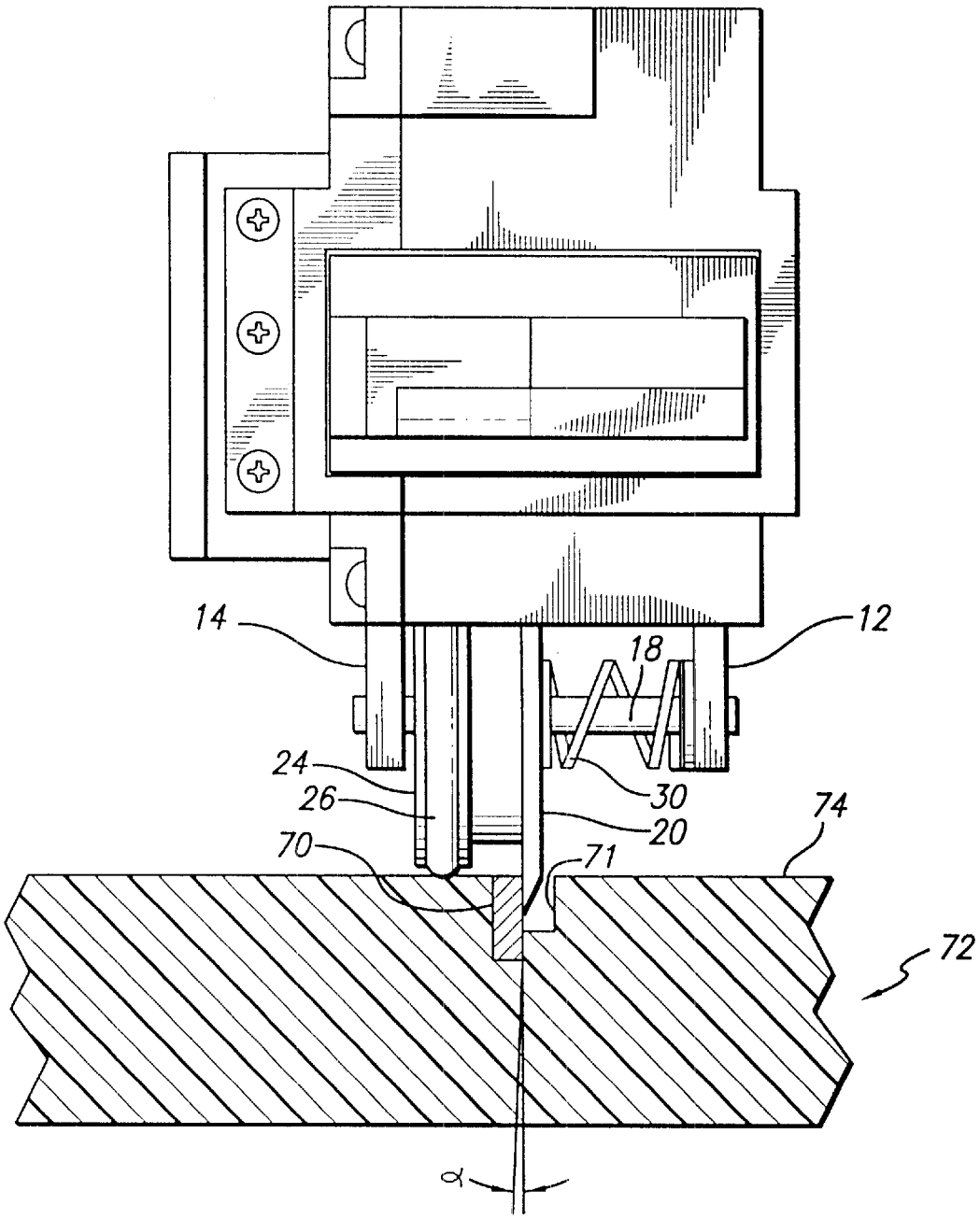
FIG. 4 left side elevation view of the cutter.
Figure 5:
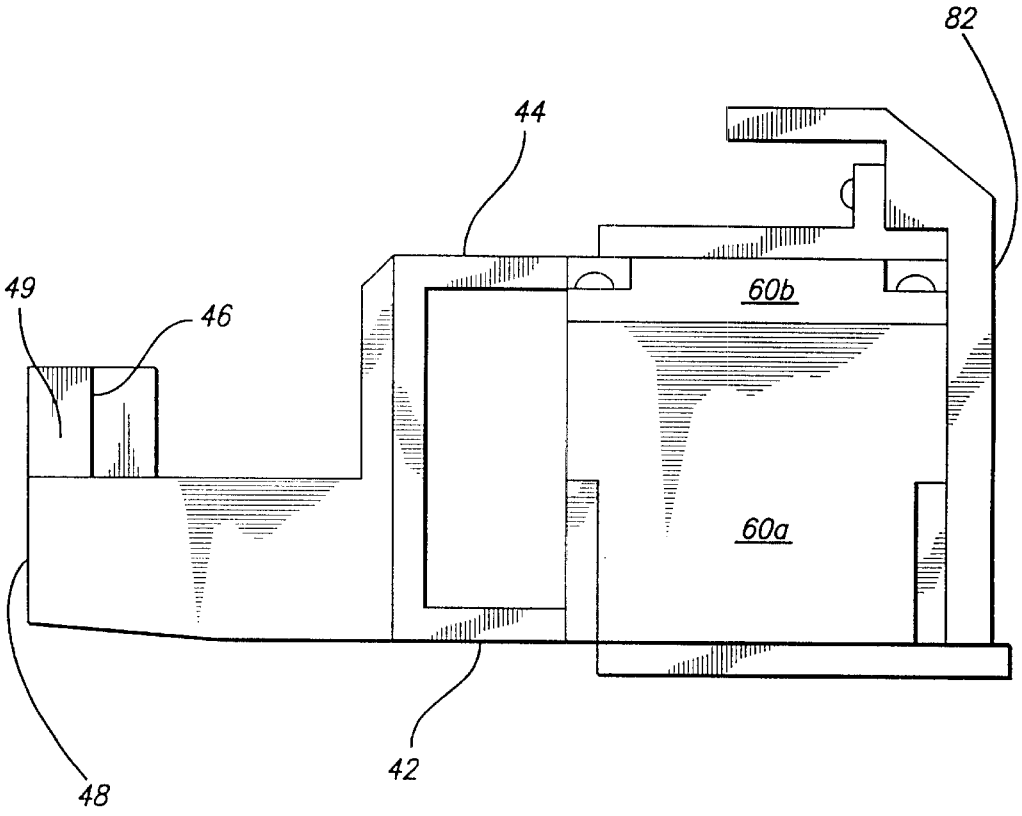
FIG. 5 is a top plan view of the cutter.
Figure 6:
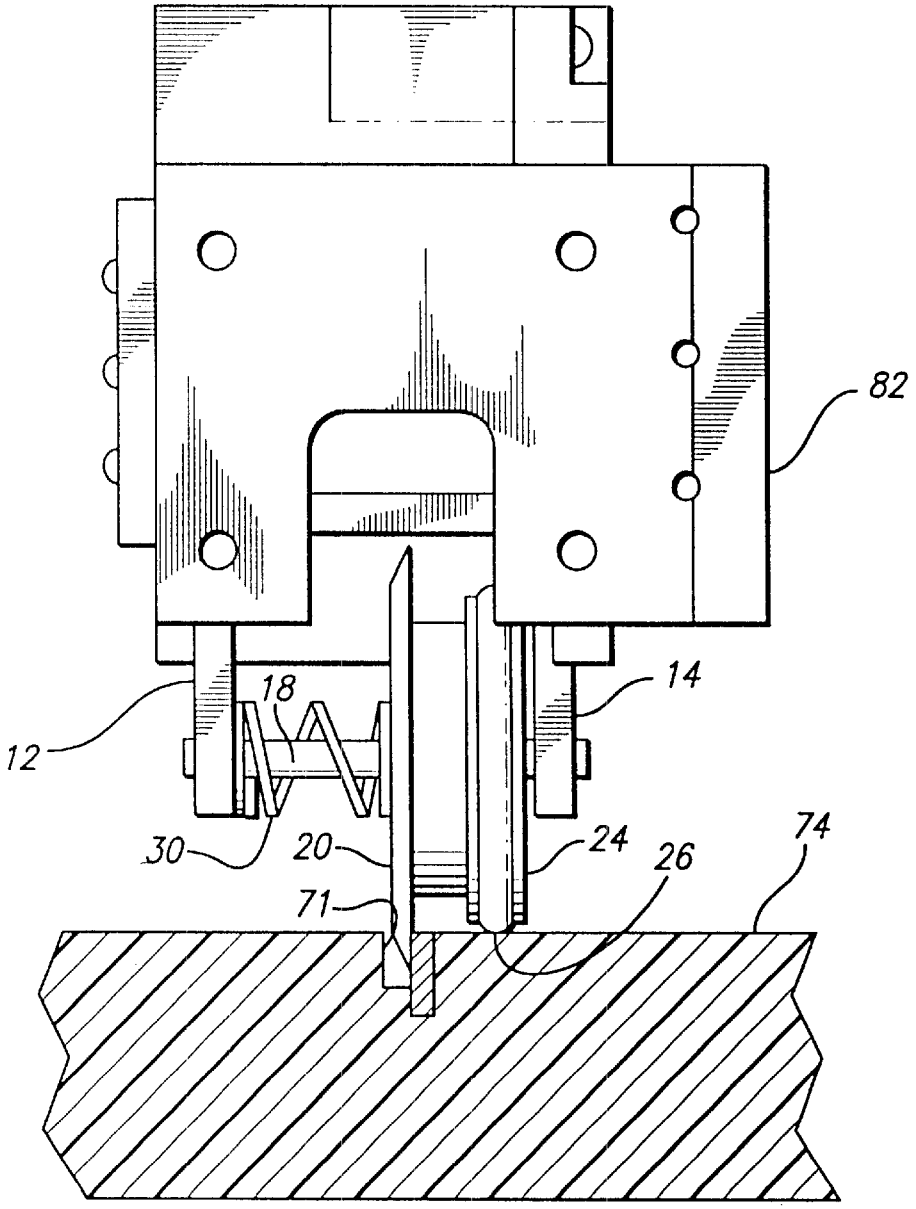
FIG. 6 is a right side elevation view of the cutter.

Also as seen in FIG. 4, the cutter drive wheel 24 preferably has an elastomeric tire 26 of smaller diameter then the cutter wheel. Both the cutter drive wheel 24 and the cutter wheel 20 are mounted on a common axle 18 with a compression spring 30 which axially biases the cutter wheel and cutter drive wheel toward one (14) of the cutter wheel support flanges 12, 14. As shown, the cutter drive wheel is affixed to the side of the cutter wheel 20 opposite from the side of the cutter wheel engaged by the spring 30 such that the spring 30 biases the cutter wheel 20 toward the stationary cutter bar.

Figure 8:
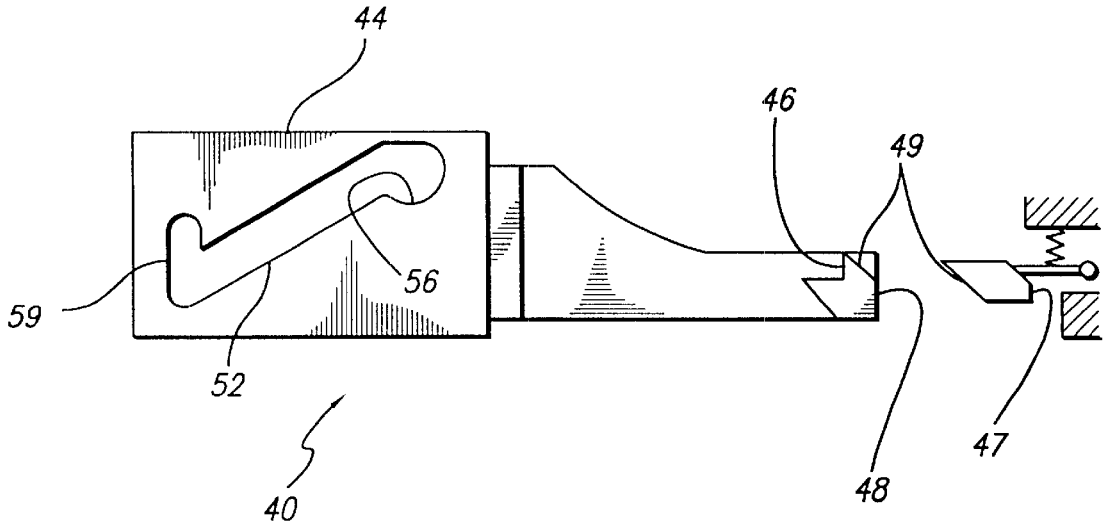
FIG. 8 is a rear elevation view of the cutter actuation hook.

The cam element carrier 40 includes a laterally extending arm having an actuation hook 46 (FIG. 8) thereon having a substantially vertically extending hook surface which is engageable with substantially vertically extending surface of a spring biased actuation hook 47 shown schematically on the printer chassis when a cutting operation is desired. Hooks 46 and 47, each have complementary beveled cam surfaces 49 thereon as shown. An abutment 48 surface on the end of the arm is engageable with a stationary portion of the printer structure to move the cutter wheel 20 from its active, lowered position to an upper, inactive position where the cutter wheel is substantially stored inside the housing 60.

Suitable means such as a mounting bracket 82 are provided for affixing the cutter assembly housing 60 to the moveable print head carriage.

Figure 9:
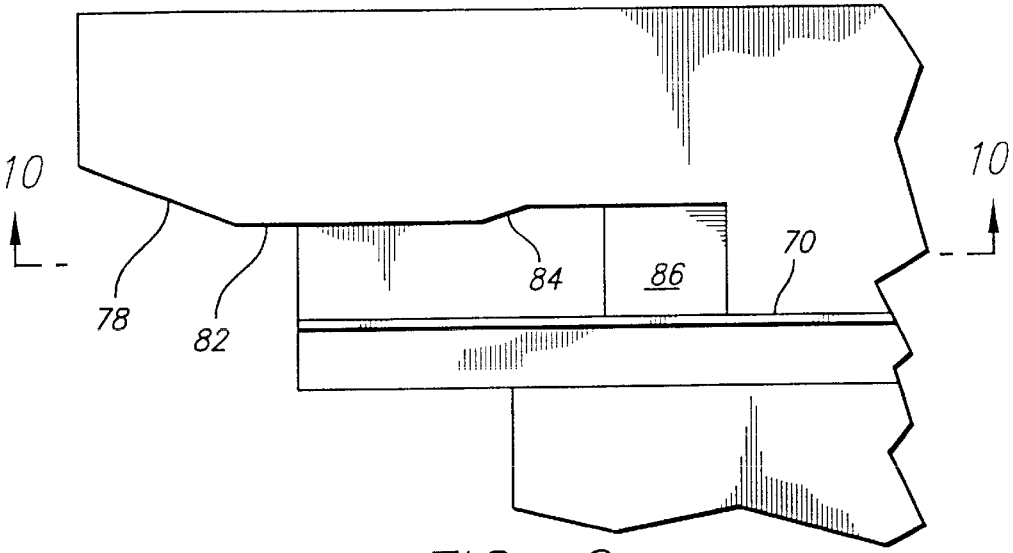
FIG. 9 is a top plan view of the end of a platen and stationary cutter bar.
Figure 10:
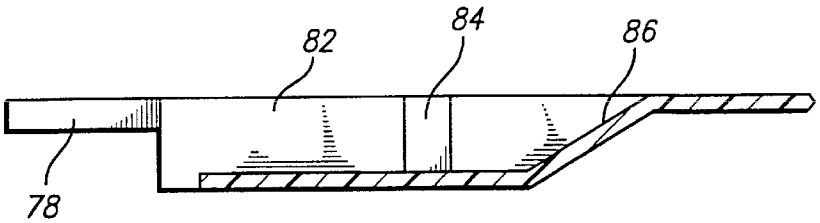
FIG. 10 is a vertical section of the platen taken at lines 10—10 on FIG. 9.
Figure 11:
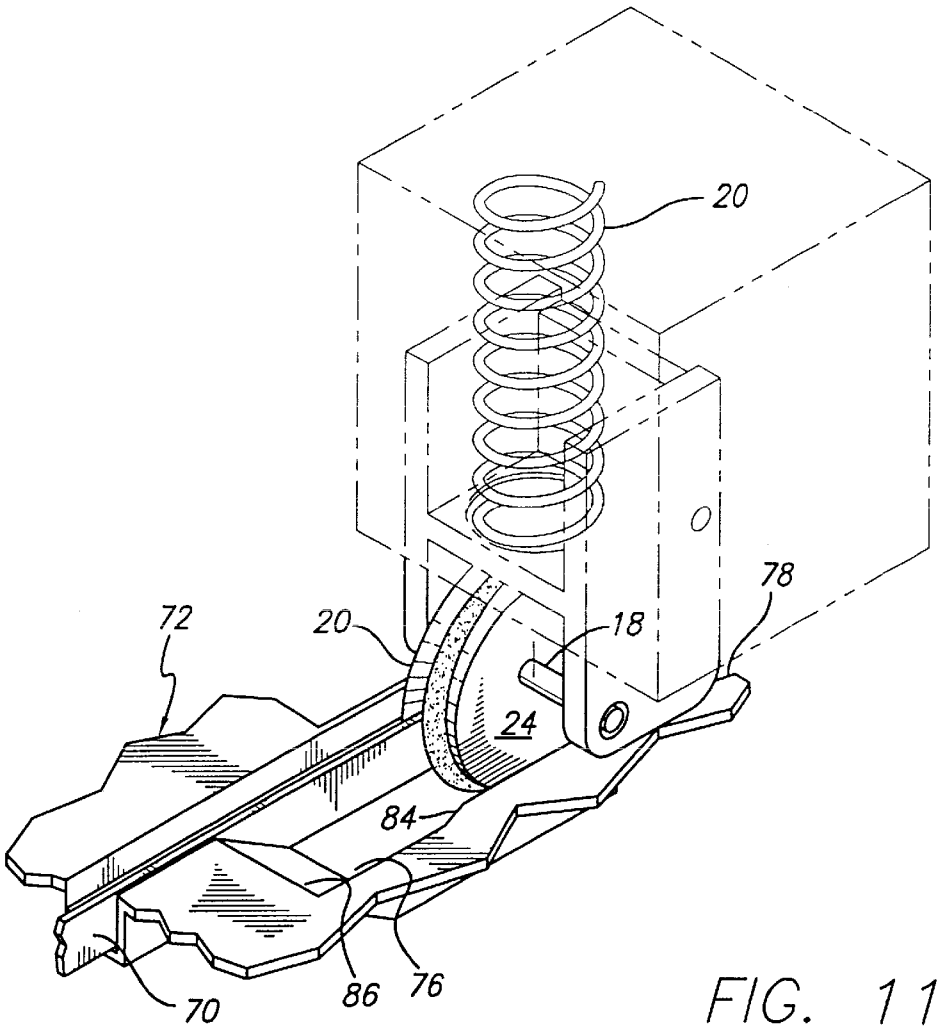
FIG. 11 is a perspective showing the relationship of the moveable cutter and platen.

The printer/plotter 2 has a stationary output platen 72 of molded plastic which has an elongated cutter bar 70 mounted in a cutter wheel receiving channel 71 in the platen which extends downwardly from the upper surface 74 of the platen in a direction transverse to the path of movement of paper through the printer/plotter 2. As seen in FIGS. 9–11, the left end of the platen 72 has a cutter wheel well 76 therein into which the cutter wheel 20 and drive wheel 24 drop freely without contact with the platen 72 or cutter bar 70. A first horizontally extending angled cam surface 78 is provided to engage the side of drive wheel 24 and move the attached drive wheel 24 and cutter wheel 26 axially toward the front of the printer against the bias of spring 30 as the cutter assembly moves to the right. This permits the rotary cutter wheel 20 from contacting the end of the stationary cutter bar 70. After the cutter wheel moves further to the right past a guide surface 82 on the platen with which the side of drive wheel 24 is still engaged, the side of drive wheel 24 engages a second horizontally extending angled cam surface 84 which allows cutter wheel 20 to come into contact with the front side of the stationary cutter bar 70. Continued movement of the cutter assembly to the right causes the tire 26 on drive wheel 24 to engage a vertically inclined ramp 86 to lift the edge of cutter wheel to the proper operational amount of overlap with the top of the cutter bar 70 and upper surface 74 of platen 72.

Figure 12:
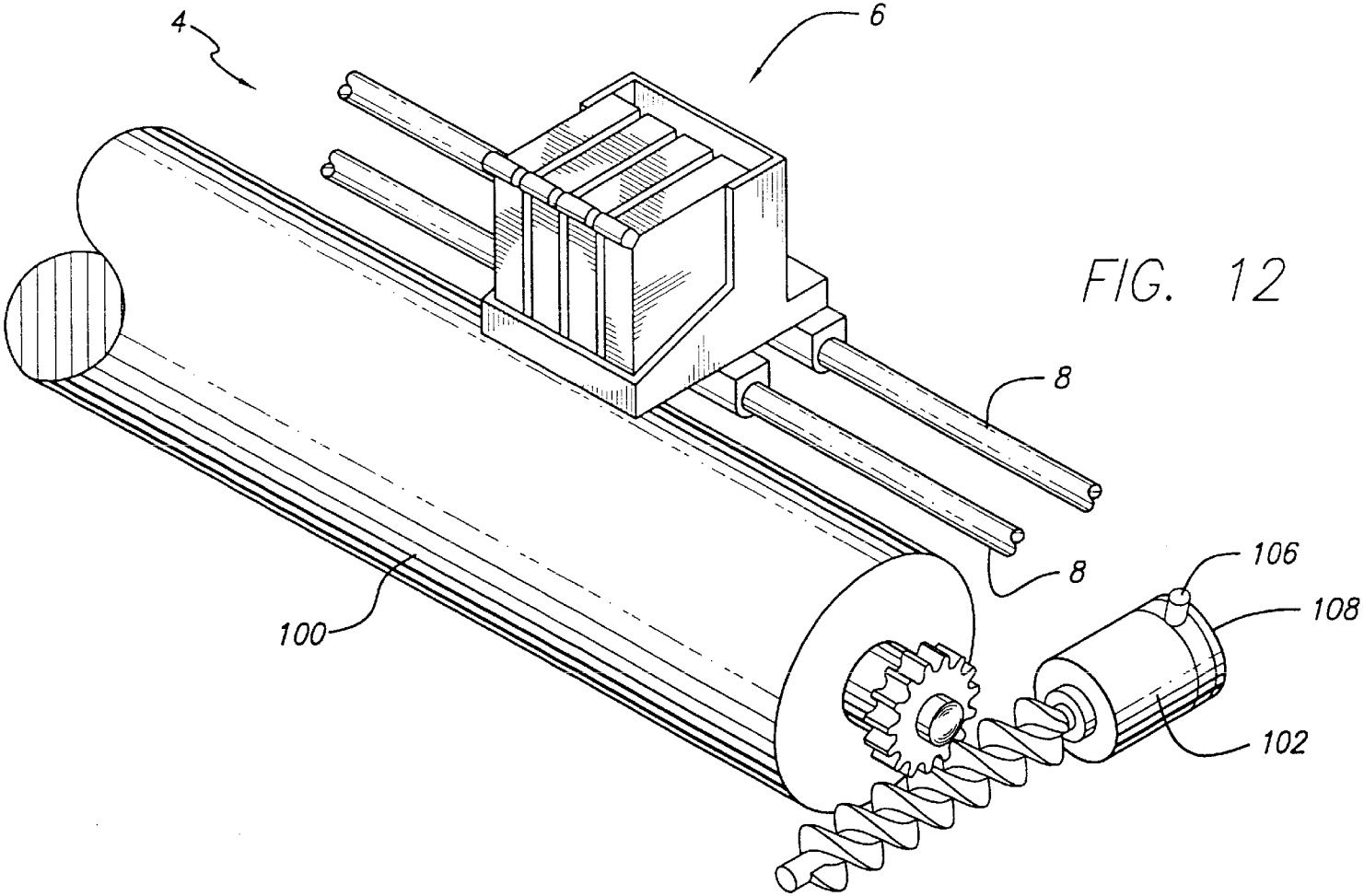
FIG. 12 is a perspective view of a media positioning roller and drive therefor, a printhead and cutter carriage being shown in phantom.

FIG. 12 shows, in perspective, a cylindrical media drive roller 100 which is driven by a reversible motor 102 having a rotary output shaft 104 which is connected by a transmission to the drive roller 100 to permit rotation of the drive roller 100 in a forward or media feed direction and a reverse or media retraction direction after a sheet of printed media has been cut from the supply roll as will be described. The position of the media may be sensed by an optical reader 106 and an encoder 108 on the motor 102. The optical reader 106 produces a series of output pulses which indirectly determines the position of the media roller 100 and hence the position of the media.

In operation, the media cutter assembly always moves with the moveable print head carriage which makes it unnecessary to have an additional cutter carriage and cutter carriage supports. This further allows the cutting edge of the rotary cutter wheel 20 to be very close to the print zone. Accordingly, in a printer equipped with the cutter assembly shown herein, the distance the media must be fed for a cutting operation may be minimized.

When a cutting operation is desired, the print head carriage 6 is moved a distance beyond the end of the length of its path of travel during printing to a position on one side of the printer (the left side as shown in FIGS. 1 and 12) where beveled surfaces 49 cross over each other and the vertical surface of the hook 46 now becomes engaged with the vertical surface of the moveable actuation hook 47 on the printer. The carriage then moves to the right during which time the engaged hook surface of hook 46 pulls the cam element carrier 40 to the left with respect to the housing thus allowing the cutter wheel support member 10 to drop the cutter wheel 20 from its inactive stored position into the well 76 as the follower rod 22 moves out of the seats 54, 56 and follows the tracks 50, 52 assisted by the bias of spring 80 to the vertically extending seats 58, 59. After the cam element carrier is pulled out of the housing to the left to its full extent of travel with respect to the cutter housing 60, hook 46 automatically disengages from the actuation hook 47 on the printer as the printhead carriage and attached cutter assembly continue to move to the right to perform a cutting operation. The cutter wheel 20 is then moved from the well 76 to the cutting position as described above with reference to FIGS. 9–11. Cutter wheel 20 is rotated by its fixed engagement with the cutter drive wheel 24 and engagement of the elastomeric tire 26 with the surface of the media to be cut which is supported on upper surface 74 of the platen 72. As cutter wheel 20 reaches the right end of its path of travel after the cut, the direction of motor 102 is reversed to cause leading edge of the roll of print media to be moved by the media roller 100 slightly rearwardly away from the cutter wheel 20 to an extent such that the cutter wheel 20 will not engage the previously cut edge of the media as the cutter retreats back across the media path toward the left end of its path of travel. As the connected print head carriage and media cutter assembly reach the left side of the printer after a completed cutting operation, the above sequence is reversed whereby the cutter wheel drops into the well 76 and the abutment 48 on the end of the cam element carrier arm then engages a stationary portion of the printer chassis thus pushing the cam element carrier 40 back to the right into the housing 60 automatically raising the cutter wheel support member 10 and cutter wheel 20 to its inactive position as the follower rod moves from seats 58, 59 along the tracks 50, 52 to the seats 54, 56.

Preferably, the rotary cutter wheel 20 is mounted such that it is not co-planar with the linear blade. A slight angle $\alpha$ between the blades (FIG. 4) is desirable for optimal cut quality.

Persons skilled in the art will readily appreciate that various modifications can be made from the preferred embodiment thus the scope of protection is intended to be defined only by the limitations of the appended claims.

What is claimed is:

1. A method of cutting printed rollfeed media comprising the steps of:

a) moving the media in a forward direction across a stationary cutter bar which extends transversely to the direction of movement of the media and then holding said media in a stationary position across said cutter bar;

b) using a printhead carriage having an attached cutter assembly to move said cutter assembly in a first direction to a position at a first side of said media to actuate said cutter assembly;

c) moving said cutter assembly and printhead carriage in a second direction to cut said media;

d) returning said cutter assembly and printhead carriage in said first direction to said first side of said media to de-actuate said cutter assembly.

2. The method of claim 1, wherein the step (c) of moving comprises moving said cutter assembly and printhead carriage to first move said cutter blade from an inoperative position to an operative position and subsequently engaging said cutter blade with said cutter bar as said cutter assembly moves from a first side of said media to a second side of said media to cut said media.

3. The method of claim 2, wherein the step (d) of returning comprises returning said cutter assembly and printhead carriage while said cutter blade remains engaged with said cutter bar and then moving said cutter blade to said inoperative position.

4. A method of cutting rollfeed media comprising the steps of:

a) moving the media in a forward direction across a stationary cutter bar which extends transversely to the direction of movement of the media and then holding said media in a stationary position across said cutter bar;

b) using a printhead carriage having an attached cutter assembly to move said cutter assembly in a first direction to a position at a first side of said media to actuate said cutter assembly;

c) moving said cutter assembly and printhead carriage in a second direction to cut said media;

d) returning said cutter assembly and printhead carriage in said first direction to said first side of said media to de-actuate said cutter assembly; and e) moving said media in a reverse direction after said media has been cut and prior to returning said cutter assembly and printhead carriage to said first side of said media a distance sufficient to prevent contact of said blade with said rollfeed media.

5. The method of claim 4, wherein said blade is a rotary cutter wheel and comprising the step of rotating said cutter wheel during said contact with said cutter bar.

* * * * *